US007975574B2

(12) United States Patent
Hu

(10) Patent No.: US 7,975,574 B2
(45) Date of Patent: Jul. 12, 2011

(54) RATCHET WRENCH WITH SWITCH MOVING IN TRANSVERSE DIRECTION

(76) Inventor: Bobby Hu, Taichung (TW)

( * ) Notice: Subject to any disclaimer, the term of this patent is extended or adjusted under 35 U.S.C. 154(b) by 370 days.

(21) Appl. No.: 12/354,831

(22) Filed: Jan. 16, 2009

(65) Prior Publication Data

US 2009/0314139 A1 Dec. 24, 2009

(30) Foreign Application Priority Data

Jun. 24, 2008 (TW) ..... 97123593 A

(51) Int. Cl.
*B25B 13/46* (2006.01)

(52) U.S. Cl. ..... 81/63.1

(58) Field of Classification Search ..... 81/61–63.2
See application file for complete search history.

(56) References Cited

U.S. PATENT DOCUMENTS 6,609,444 B1 * 8/2003 Hsien ..... 81/63.2
6,761,091 B2 * 7/2004 Hsien ..... 81/63.2
6,886,428 B1 * 5/2005 Hsien ..... 81/63.2
7,089,830 B2 * 8/2006 Hu ..... 81/63.1
7,096,763 B1 * 8/2006 Hsieh ..... 81/63.2
7,121,171 B2 * 10/2006 Hsien ..... 81/63.2
7,207,244 B2 * 4/2007 Chen ..... 81/63.2
7,299,720 B1 * 11/2007 Schultz et al. ..... 81/63.1
7,353,735 B2 * 4/2008 Patel et al. ..... 81/63
7,827,886 B2 * 11/2010 Hu ..... 81/63.1
7,836,798 B2 * 11/2010 Hu ..... 81/63.1
2004/0011162 A1 * 1/2004 Hsien ..... 81/63.2
2006/0117913 A1 * 6/2006 Chen ..... 81/63.1

* cited by examiner

*Primary Examiner* — D. S Meislin
(74) *Attorney, Agent, or Firm* — Alan Kamrath; Kamrath & Associates PA

(57) ABSTRACT

A ratchet wrench includes a head and a handle interconnected to the head. The head includes a first compartment rotatably receiving a drive member. Two pawls are slideably received in a compartment of the head. A switch is slideably received in a third compartment of the head between first, second, and third operative positions to change the driving direction of the ratchet wrench. An actuator is slideably received in the second compartment and includes two guiding portions selectively engaged with one of the pawls when the switch is in one of the first and second operative positions. The pawls are disengaged from the guiding portions and engaged with the drive member when the switch is in the third operative positions, allowing the handle and the drive member to rotate in either of two directions driving a fastener, and not allowing free rotation of the handle relative to the drive member in either of the two directions without driving the fastener.

12 Claims, 10 Drawing Sheets

RATCHET WRENCH WITH SWITCH MOVING IN TRANSVERSE DIRECTION

BACKGROUND OF THE INVENTION

The present invention relates to a ratchet wrench and, more particularly, to a ratchet wrench that includes a switch moving in a transverse direction for reliably moving two pawls of the ratchet wrench.

FIG. 10 shows a conventional ratchet wrench 60 including a body 62 having a head 64 with first, second, and third compartments 66, 68, and 70 in communication with each other. A gear wheel 72 is rotatably received in first compartment 66. Two pawls 74 are slideably received in second compartment 68. Third compartment 70 has two positioning grooves in a bottom wall thereof. A control member 76 is rotatably received in third compartment 70 between two operative positions. A resilient positioning plate is mounted to a bottom of control member 76 and includes a resilient protrusion selectively engaged in one of the positioning grooves. A follower 78 is coupled with control member 76 and has an end extending into second compartment 68. One of pawls 74 is moved away and disengaged from gear wheel 72 through movement of follower 78 when control member 76 is pivoted to one of the operative positions. However, transmission of follower 78 is not always reliable, such that both pawls 74 sometimes come in contact with the gear wheel and generate noise while driving a fastener with the ratchet wrench. Furthermore, the size of the resilient protrusion engaged with either of the positioning grooves is restricted to limit the overall thickness of the ratchet wrench. The height of the resilient protrusion must be smaller than the wall thickness of head 64 of body 62. Thus, the coupling area between the resilient protrusion and the positioning grooves is too small to provide reliable positioning effect. As a result, the resilient protrusion may disengage from the positioning grooves when a large rotational force is applied to ratchet wrench 60. Furthermore, ratchet wrench 60 can not be utilized as a conventional wrench of the type capable of driving fasteners in either direction and not allowing free rotation in the reverse direction, which may be required in some cases. As an example, when it is desired to proceed with slight tightness adjustment of a fastener by rotating the fastener in the tightening direction and/or loosening direction before the desired tightness is obtained, a user has to frequently move the control member between the two operative positions to change the driving direction of the ratchet wrench, which is time-consuming and laborsome.

Thus, a need exists for a ratchet wrench having three operative positions to allow easy operation in the slight tightness adjustment while having reliable positioning effect in the operative positions.

BRIEF SUMMARY OF THE INVENTION

The present invention solves this need and other problems in the field of easy operation of wrenches by providing, in a preferred form, a ratchet wrench including a head and a handle interconnected to the handle. The head includes first and second sides spaced in a thickness direction. The head further includes a first compartment extending in the thickness direction. The head further includes a second compartment in communication with the first compartment and a third compartment in communication with the second compartment. A drive member is rotatably received in the first compartment and includes a plurality of teeth in an outer periphery thereof. A first pawl and a second pawl are slideably received in the second compartment. Each pawl includes an inner face facing the teeth of the drive member. The inner face of each pawl includes a plurality of teeth releasably engaged with the teeth of the drive member. An elastic element is mounted between the first and second pawls to bias the pawls away from each other to engage the teeth of the pawls with the teeth of the drive member. The first pawl includes a first coupling portion, and the second pawl includes a second coupling portion. A switch is slideably received in the third compartment between first, second, and third operative positions in a width direction transverse to the thickness direction. An actuator is slideably received in the second compartment and includes an engaging portion having a first end engaged with the switch to move therewith. The engaging portion further has a second end in the second compartment. The actuator further includes an extension extending transversely to the second end of the engaging portion. The extension includes a first guiding portion and a second guiding portion.

When the switch is in the first operative position, the teeth of the first pawl are engaged with the teeth of the drive member, and the second guiding portion of the actuator is engaged with the second coupling portion of the second pawl to disengage the teeth of the second pawl from the teeth of the drive member, allowing the handle and the drive member to rotate in a first direction driving a fastener in the first direction, and allowing the handle to rotate freely relative to the drive member in a second direction reverse to the first direction without driving the fastener.

When the switch is in the second operative position, the teeth of the second pawl are engaged with the teeth of the drive member, and the first guiding portion of the actuator is engaged with the first coupling portion of the first pawl to disengage the teeth of the first pawl from the teeth of the drive member, allowing the handle and the drive member to rotate in the second direction driving the fastener in the second direction, and allowing the handle to rotate freely relative to the drive member in the first direction without driving the fastener.

When the switch is in the third operative position, the teeth of each pawl are engaged with the teeth of the drive member, allowing the handle and the drive member to rotate in either of the first and second directions driving the fastener, and not allowing free rotation of the handle relative to the drive member in either of the first and second directions without driving the fastener.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
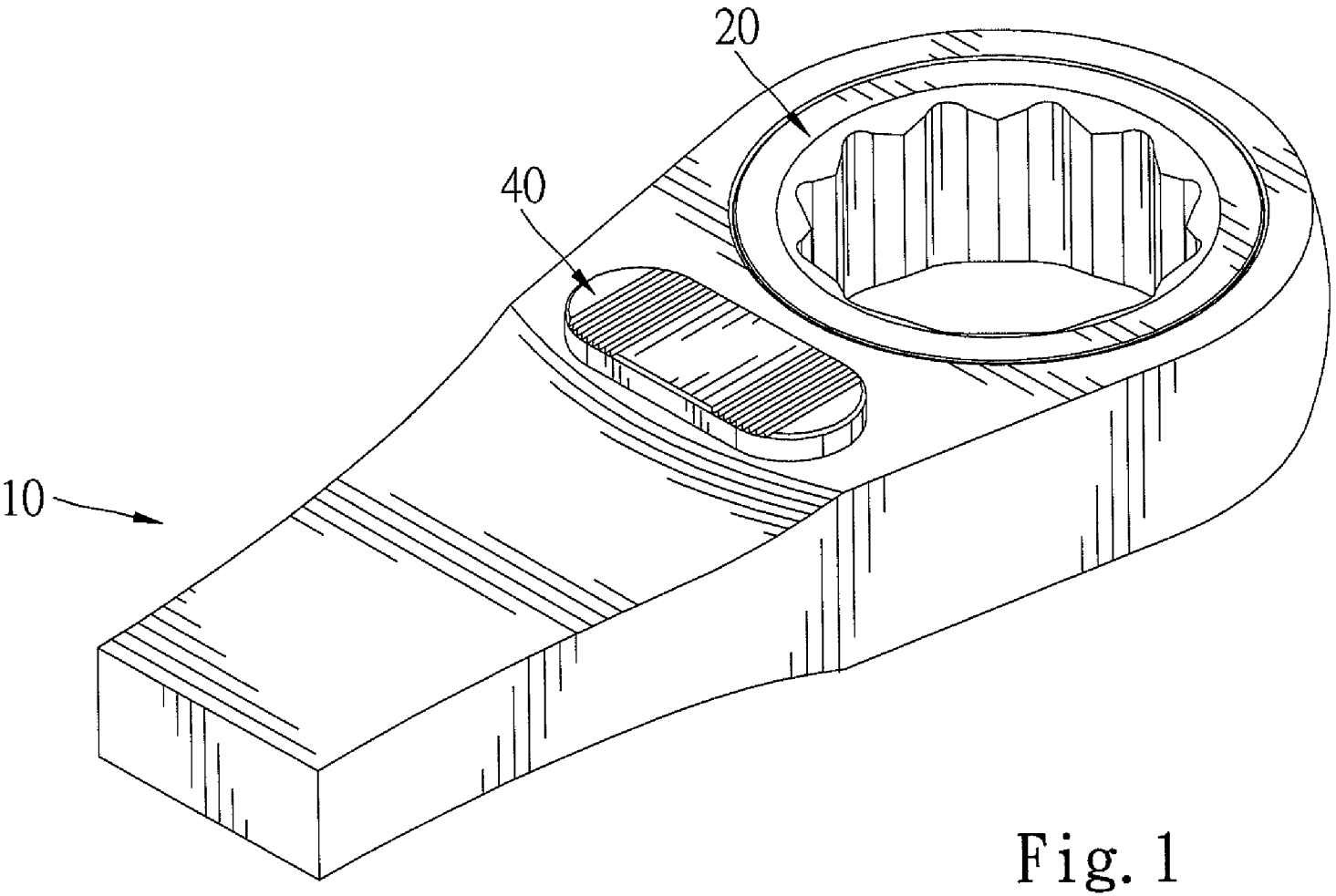
FIG. 1 shows a partial, perspective view of a ratchet wrench according to the preferred teachings of the present invention.
Figure 2:
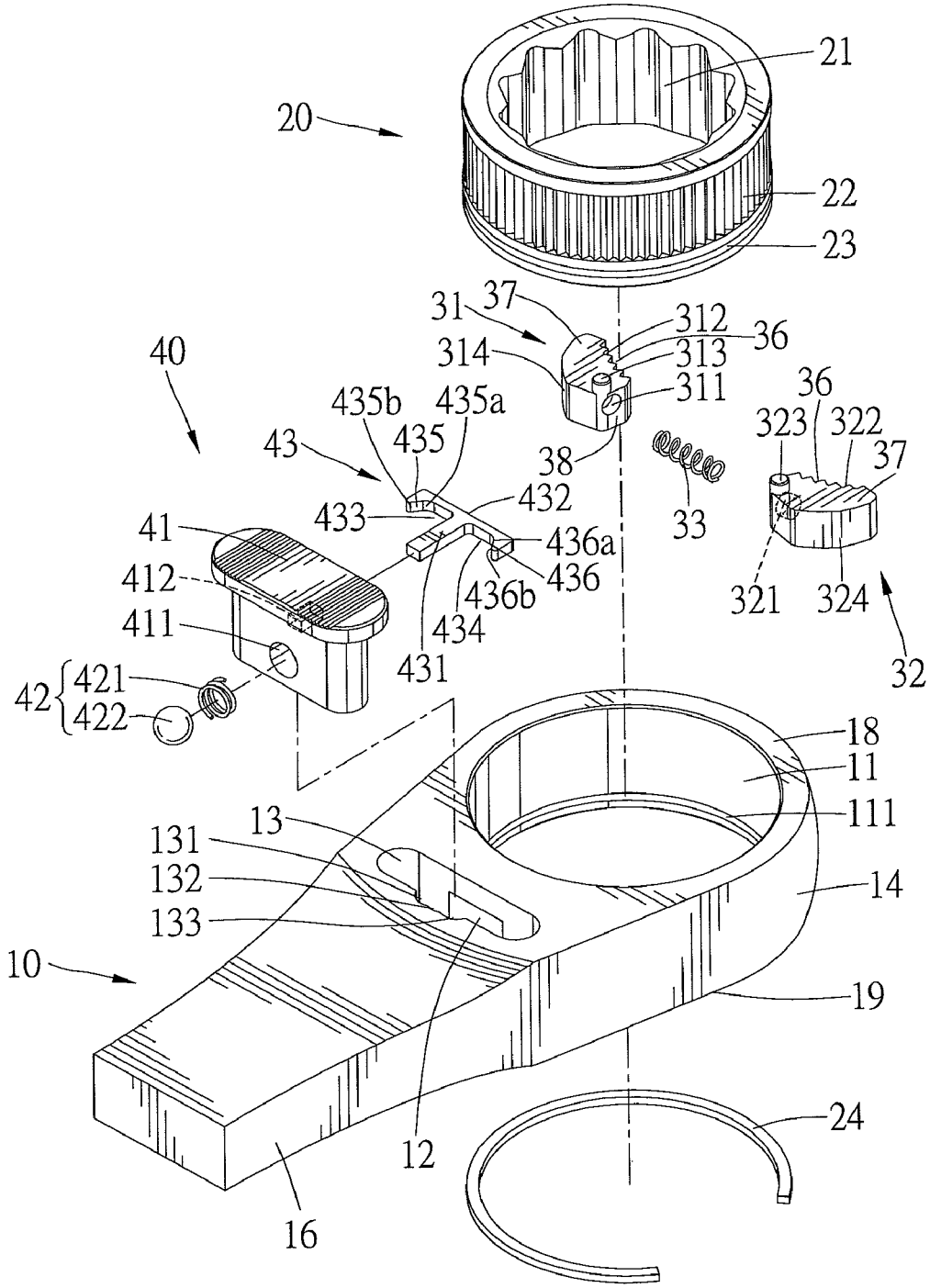
FIG. 2 shows a partial, exploded, perspective view of the ratchet wrench of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "upper", "lower", "side", "end", "portion", "section", "downward", "annular", "clockwise", "counterclockwise", "length", "width", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A ratchet wrench according to the preferred teachings of the present invention is shown in the drawings and generally includes a body 10 having a head 14 and a handle 16 interconnected to head 14. Head 14 includes first and second sides 18 and 19 spaced in a thickness direction and a first compartment 11 in the most preferred form shown as a circular through-hole extending from first side 18 through second side 19. An annular groove 111 is defined in an end of a peripheral wall of first compartment 11. A second compartment 12 is defined between first and second sides 18 and 19 and in communication with first compartment 11. Head 14 further includes a third compartment 13 in communication with second compartment 12 and extending in a width direction transverse to and most preferably perpendicular to the thickness direction. In the most preferred form shown, third compartment 13 is substantially rectangular in section and extends from first side 18 toward and spaced from second side 19. Third compartment 13 includes a wall having first, second, and third positioning grooves 131, 132, 133 spaced in the width direction. Second positioning groove 132 is intermediate first and third positioning grooves 131 and 133. An opening is defined in another wall of third compartment 13 to communicate third compartment 13 with second compartment 12. Second compartment 12 is intermediate first and third compartments 11 and 13 in a length direction perpendicular to the thickness and width directions.

According to the preferred form shown, a drive member 20 is rotatably received in first compartment 11. Drive member 20 includes a driving section 21 in a central portion thereof for directly or indirectly engaging with a fastener to be loosened or tightened. According to the most preferred form shown, driving section 21 includes a through-hole having a polygonal inner periphery for engaging and driving a fastener. Other forms of driving section 21 would be within the skill of the art. Drive member 20 further includes a plurality of teeth 22 in an outer periphery thereof. An engaging portion 23 in the most preferred form shown as an annular groove is formed in an end of the outer periphery of drive member 20. A retainer ring 24 in the most preferred form shown as a C-clip is partially received in engaging portion 23 of drive member 20 and partially received in annular groove 131 of head 14, allowing rotation of drive member 20 relative to head 14 while retaining drive member 20 in first compartment 11.

According to the preferred form shown, first and second pawls 31 and 32 slideably received in two ends of second compartment 12. Each of first and second pawls 31, 32 includes an inner face 36 facing teeth 22 of drive member 20. Inner face 36 of each of first and second pawls 31 and 32 includes a plurality of teeth 312, 322 releasably engaged with teeth 22 of drive member 20. Each of first and second pawls 31 and 32 further includes a top face 37 transverse to inner face 36. A first coupling portion 313 in the most preferred form shown as a peg is formed on an inner end of top face 37 of first pawl 31 and has a top spaced from top face 37 in the thickness direction. A second coupling portion 323 in the most preferred form shown as a peg is formed on an inner end of top face 37 of second pawl 32 and has a top spaced from top face 37 in the thickness direction. Each of first and second pawls 31 and 32 further includes an outer face 314, 324 opposite to the inner face 36. Top face 37 of each of first and second pawls 31 and 32 extends between inner and outer faces 36 and 314, 324. Outer face 314, 324 of each of first and second pawls 31 and 32 slideably abuts a peripheral wall of second compartment 12 facing first compartment 11. Each of first and second pawls 31 and 32 further includes an end face 38 transverse to top face 37 and to inner face 36. End faces 38 face each other and each has a receptacle 311, 321. An elastic element 33 in the most preferred form shown as a spring is attached between first and second pawls 31 and 32 and includes two ends received in receptacles 311 and 321. Elastic element 33 biases first and second pawls 31 and 32 away from each other to engage teeth 312, 322 of first and second pawls 31 and 32 with teeth 22 of drive member 20.

According to the preferred form shown, a control member 40 is slideably mounted in second and third compartments 12 and 13 for moving first and second pawls 31 and 32. In the most preferred form shown, control member 40 includes a switch 41 slideably received in third compartment 13 in the width direction between first, second, and third operative positions. Switch 41 includes a hole 412 in the most preferred form shown as a blind hole in a side thereof and a receptacle 411 in the most preferred form shown as a blind hole in an opposite side thereof. Receptacle 411 receives a positioning device 42 that includes a ball 422 and an elastic member 421 in the most preferred form shown as a spring. Ball 422 is biased by elastic member 421 to selectively engage with one of first, second, and third positioning grooves 131, 132, and 133. A portion of switch 41 protrudes out of third compartment 13 for manual operation.

In the most preferred form shown, control member 40 further includes an actuator 43 slideably received in second compartment 12 and having T-shaped cross sections. Specifically, actuator 43 includes an engaging portion 431 having a first end extending into third compartment 13 and engaged in hole 412 of switch 12 to move therewith. Engaging portion 431 further includes a second end in second compartment 12.

Thus, movement of switch 41 in third compartment 13 causes movement of actuator 43 in second compartment 12 in the width direction. An extension 432 extends transversely and preferably perpendicularly to the second end of engaging portion 431. Extension 432 includes first and second ends on opposite sides of engaging portion 431 and respectively having first and second guiding portions 435, 436. Each of first and second guiding portions 435 and 436 extends transversely to extension 432 and includes a first contact section 435*a*, 436*a* and a second contact section 435*b*, 436*b* having a spacing to extension 432 larger than first contact section 435*a*, 436*a*. A first space 433 is defined between first guiding portion 435 and engaging portion 431. A second space 434 is defined between second guiding portion 436 and engaging portion 431. In the most preferred form shown, each of first and second guiding portions 435 and 436 are inclined and at an obtuse angle with extension 432. Furthermore, second contact section 435*b*, 436*b* of each of first and second guiding portions 435 and 436 has a spacing to engaging portion 431 larger than first contact section 435*a*, 436*a*. Further, each of first and second contact sections 435*a*, 436*a*, 435*b*, 436*b* has decreasing spacings to engaging portion 431 away from switch 41. Note that engaging portion 431 of actuator 43 extends from second compartment 12 through the opening into third compartment 13 with first end of engaging portion 431 engaged in hole 411 of switch 41. Actuator 43 can be formed by punching a piece of metal.

Figure 3:
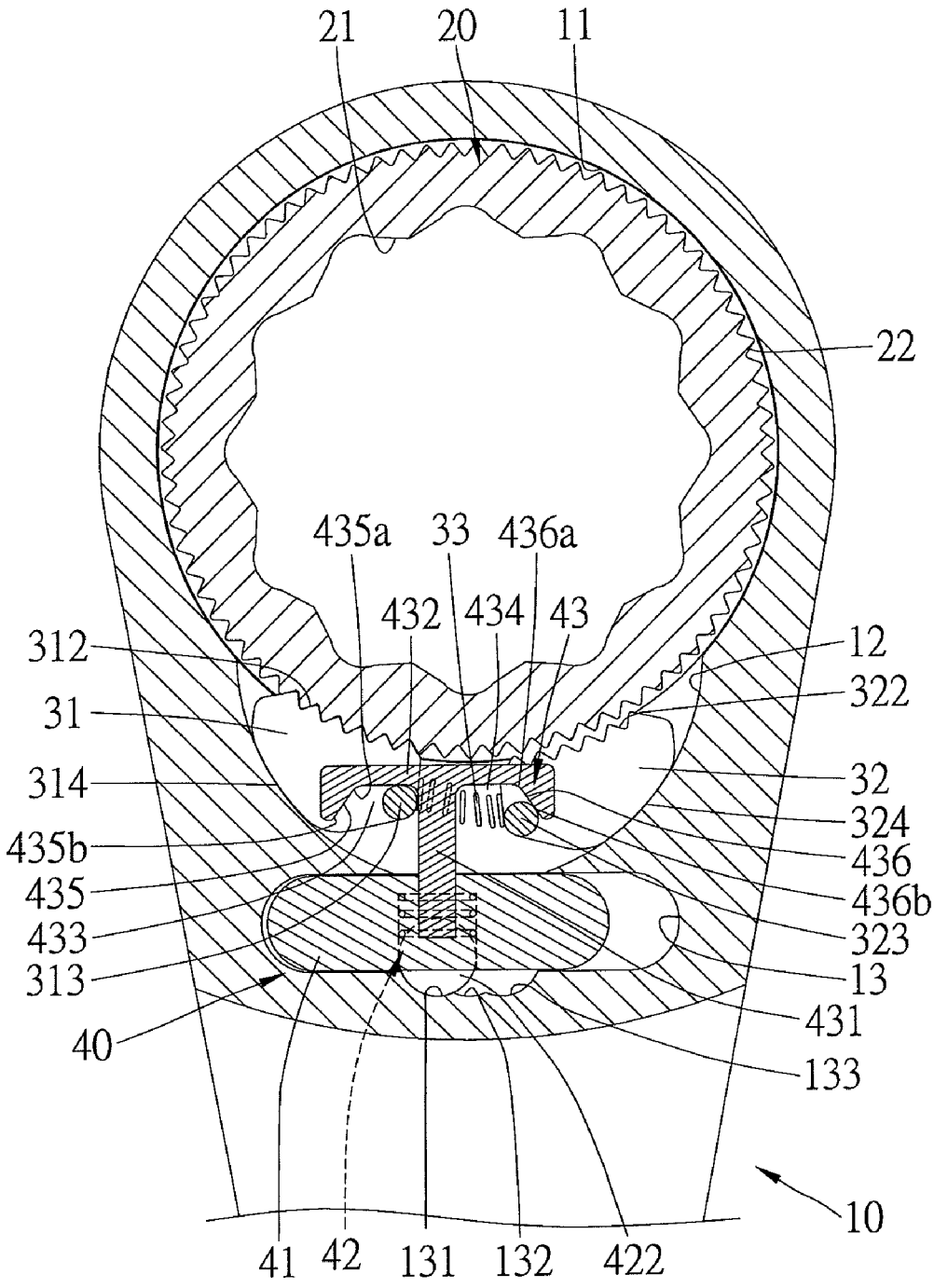
FIG. 3 shows a partial, cross sectional view of the ratchet wrench of FIG. 2 with a switch of the ratchet wrench in a first operative position.

Now that the basic construction of the ratchet wrench of the preferred teachings of the present invention has been explained, the operation and some of the advantages of the ratchet wrench can be set forth and appreciated. In particular, for the sake of explanation, it will be assumed that switch 41 is initially in the first operative position (FIG. 3). Ball 422 is received in first positioning groove 131. Teeth 312 of first pawl 31 are engaged with teeth 22 of drive member 20. First coupling portion 313 of first pawl 31 is received in first space 433 adjacent engaging portion 431. Second contact section 436*b* of second guiding portion 436 is engaged with second coupling portion 323 of second pawl 32, so that teeth 322 of second pawl 32 are disengaged from teeth 22 of drive member 20. In this state, handle 16 and drive member 20 can rotate in the counterclockwise direction to drive a fastener in the counterclockwise direction. Furthermore, handle 16 can rotate freely relative to drive member 20 in the clockwise direction without driving the fastener.

Figure 4:
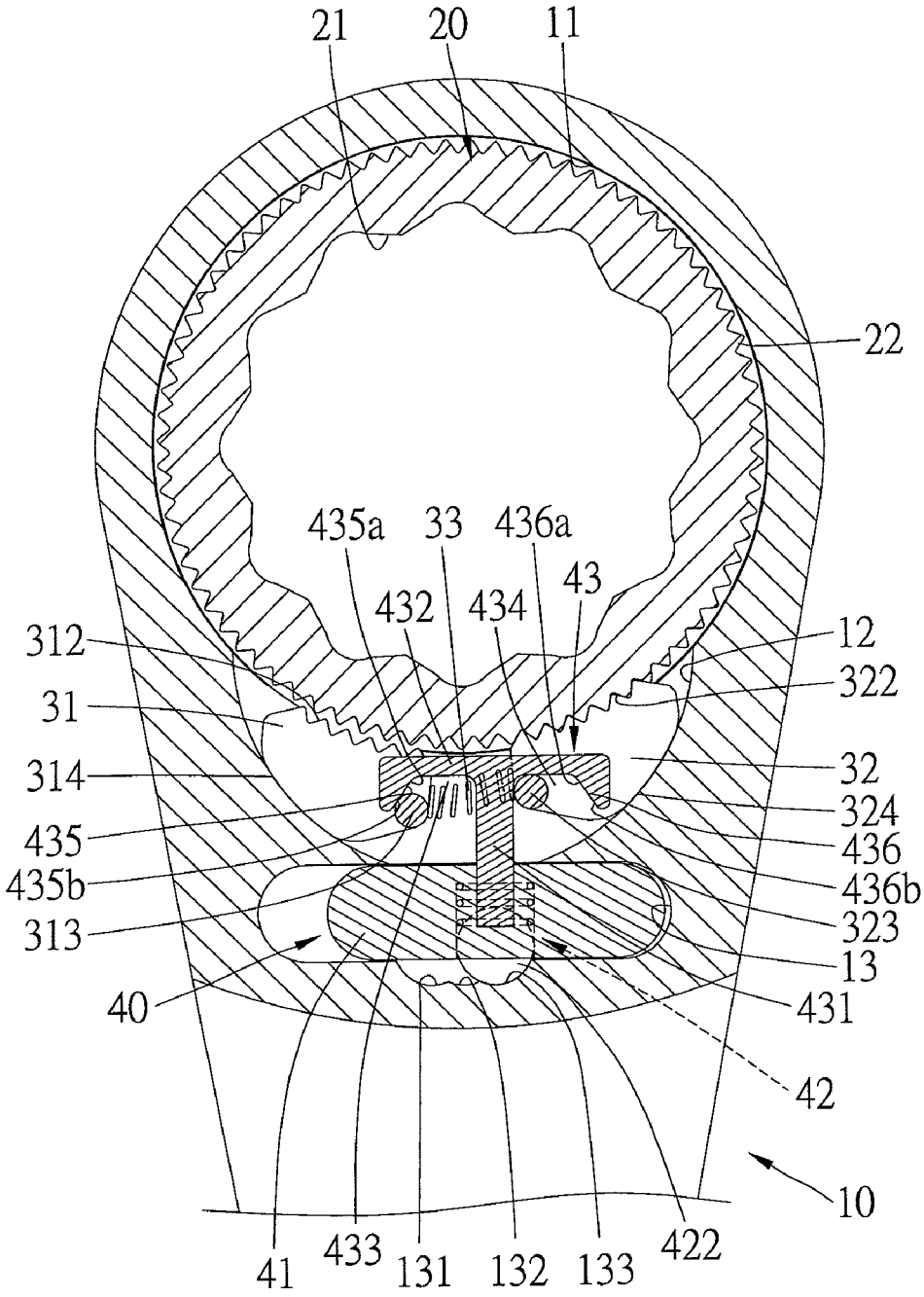
FIG. 4 shows a partial, cross sectional view of the ratchet wrench of FIG. 2 with the switch in a second operative position.

When switch 41 is in second operative position (FIG. 4), ball 422 is received in third positioning groove 133. Teeth 322 of second pawl 32 are engaged with teeth 22 of drive member 20. Second coupling portion 323 of second pawl 32 is received in second space 434 adjacent engaging portion 431. Second contact section 435*b* of first guiding portion 435 is engaged with first coupling portion 313 of first pawl 32, so that teeth 312 of first pawl 31 are disengaged from teeth 22 of drive member 20. In this state, handle 16 and drive member 20 can rotate in the clockwise direction to drive the fastener in the clockwise direction. Furthermore, handle 16 can rotate freely relative to drive member 20 in the counterclockwise direction without driving the fastener.

Figure 5:
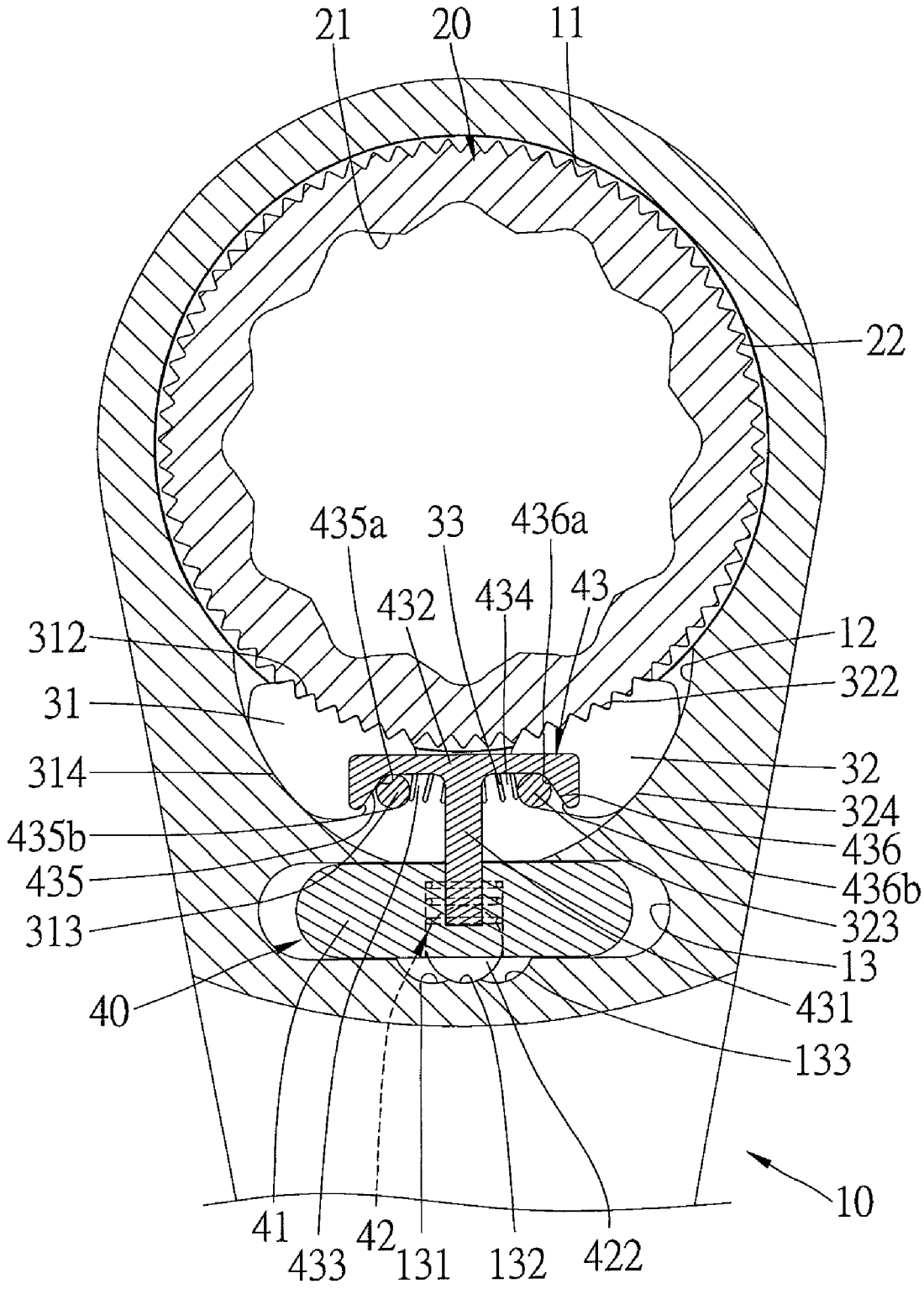
FIG. 5 shows a partial, cross sectional view of the ratchet wrench of FIG. 2 with the switch in a third operative position.

When switch 41 is in the third operative position intermediate the first and second operative positions in the width direction (FIG. 5), ball 422 is received in second positioning groove 132. First coupling portion 313 of first pawl 31 is received in first space 433 adjacent engaging portion 431. Second coupling portion 323 of second pawl 32 is received in second space 434 adjacent engaging portion 431. Namely, first and second coupling portions 313 and 323 are disengaged from second contact sections 435*b* and 436*b*. Teeth 312 and 322 of first and second pawls 31 and 32 are engaged with teeth 22 of drive member 20 under action of elastic element 33, allowing handle 16 and drive member 20 to rotate in either clockwise or counterclockwise direction to drive the fastener in the same direction. Free rotation of handle 16 relative to drive member 20 in either direction without driving the fastener is not allowed. Thus, the ratchet wrench according to the preferred teachings of the present invention can be utilized to perform slight tightness adjustment of the fastener when switch 41 is in the third operative position.

It is noted that when switch 41 is moved between the first, second, and third operative positions, first coupling portion 313 of first pawl 31 is movably restrained in first space 433, and second coupling portion 323 of second pawl 32 is movably restrained in second space 434. Furthermore, first coupling portion 313 of first pawl 31 comes in contact with and is guided by first contact section 435*a* of first guiding portion 435 when switch 41 is moved from the third operative position to the second operative position. Further, second coupling portion 323 of second pawl 32 comes in contact with and is guided by first contact section 436*a* of second guiding portion 436*b* when switch 41 is moved from the third operative position to the first operative position. Further, extension 432 slideably abuts top faces 37 of first and second pawls 31 and 32.

Figure 6:
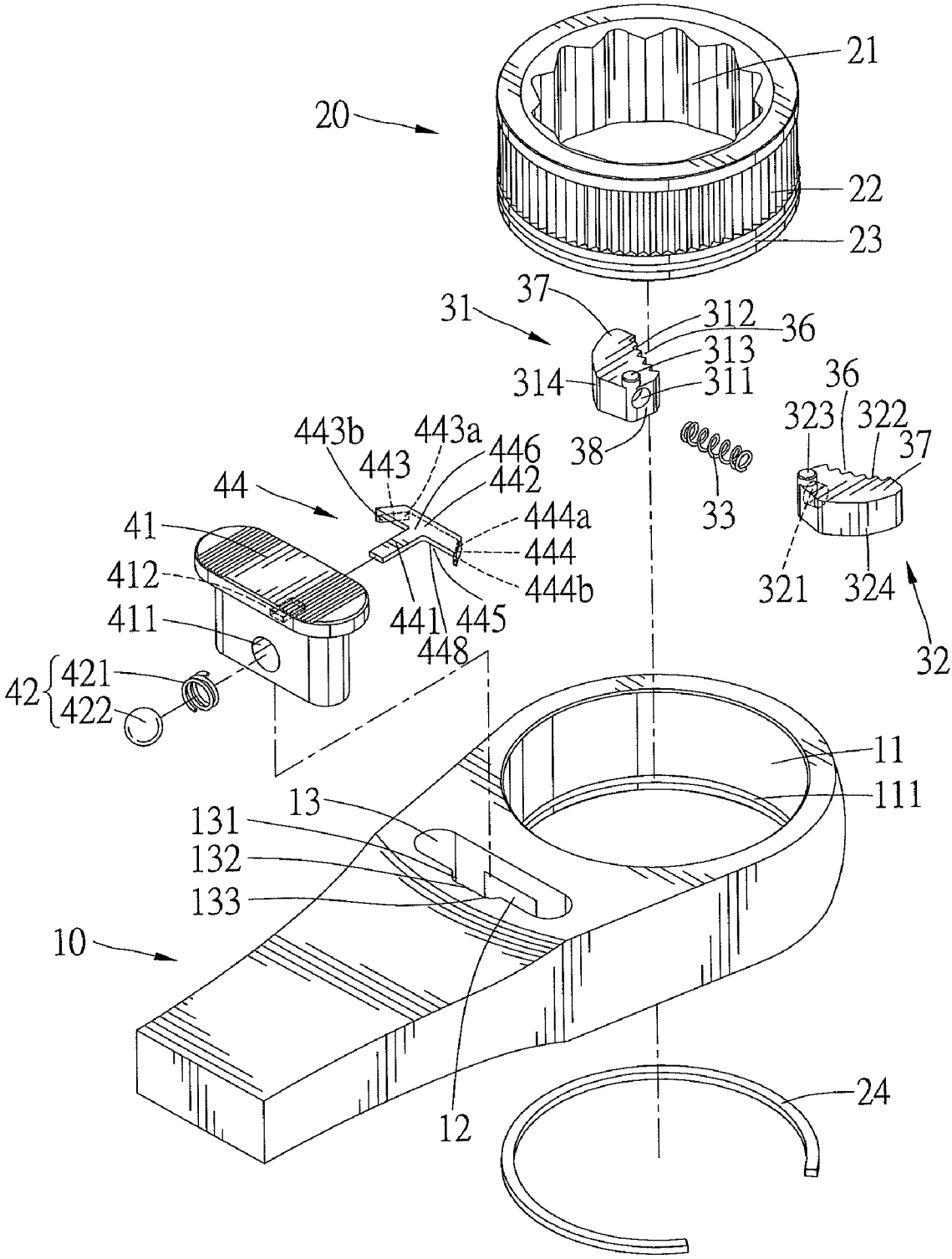
FIG. 6 shows a partial, exploded, perspective view of a ratchet wrench of a modified embodiment according to the preferred teachings of the present invention.

Actuator 43 can have other forms. In a modified embodiment shown in FIG. 6, actuator (now designated by 44) includes an engaging portion 441 having a first end extending into third compartment 13 and engaged in hole 412 of switch 12 to move therewith. Engaging portion 441 further includes a second end in second compartment 12. Thus, movement of switch 41 in third compartment 13 causes movement of actuator 44 in second compartment 12 in the width direction. An extension 442 extends transversely and preferably perpendicularly to the second end of engaging portion 441. Extension 442 includes upper and lower faces 446 and 448 spaced in the thickness direction. Extension 442 includes first and second ends on opposite sides of engaging portion 441 and respectively having first and second guiding portions 443, 444. Each of first and second guiding portions 443 and 444 extends downwardly from lower face 448 and transversely to extension 442 and includes a first contact section 443*a*, 444*a* and a second contact section 443*b*, 444*b* having a spacing to extension 442 larger than first contact section 443*a*, 444*a*. A space 445 is defined between first and second guiding portions 443 and 444 and lower face 448 of extension 442. In the most preferred form shown, each of first and second guiding portions 443 and 444 are inclined and at an obtuse angle with extension 442. Furthermore, second contact section 443*b*, 444*b* of each of first and second guiding portions 443 and 444 has a spacing to engaging portion 441 larger than first contact section 443*a*, 444*a*. Further, each of first and second contact sections 443*a*, 444*a*, 443*b*, 444*b* has decreasing spacings to engaging portion 441 away from switch 41. Actuator 44 can be formed by bending a piece of metal.

Figure 7:
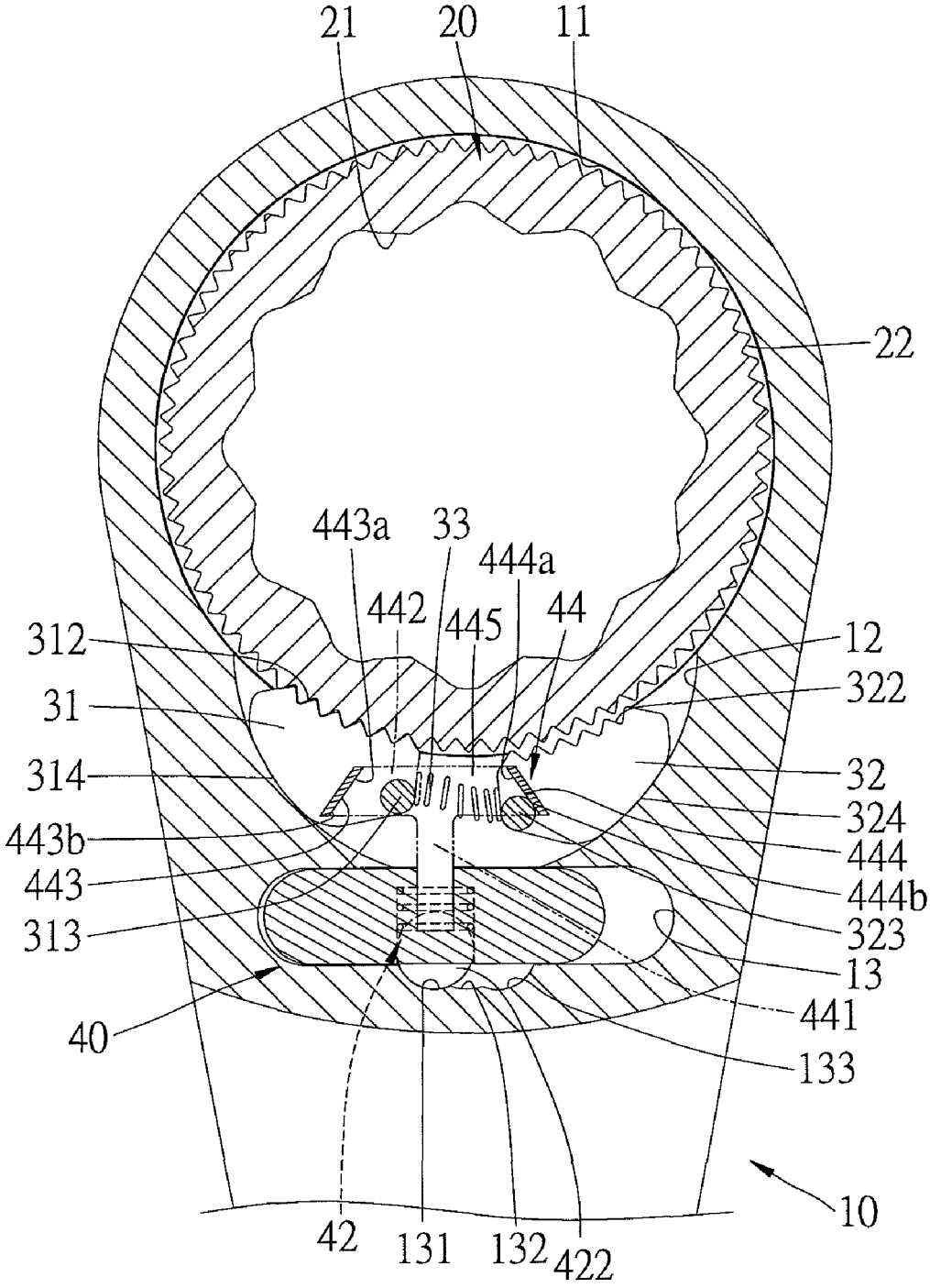
FIG. 7 shows a partial, cross sectional view of the ratchet wrench of FIG. 6 with a switch of the ratchet wrench in a first operative position.

When switch 41 is initially in the first operative position (FIG. 7), ball 422 is received in first positioning groove 131. Teeth 312 of first pawl 31 are engaged with teeth 22 of drive member 20. First coupling portion 313 of first pawl 31 is received in space 445 adjacent engaging portion 441. Second contact section 444*b* of second guiding portion 444 is engaged with second coupling portion 323 of second pawl 32, so that teeth 322 of second pawl 32 are disengaged from teeth 22 of drive member 20. In this state, handle 16 and drive member 20 can rotate in the counterclockwise direction to drive the fastener in the counterclockwise direction. Furthermore, handle 16 can rotate freely relative to drive member 20 in the clockwise direction without driving the fastener.

Figure 8:
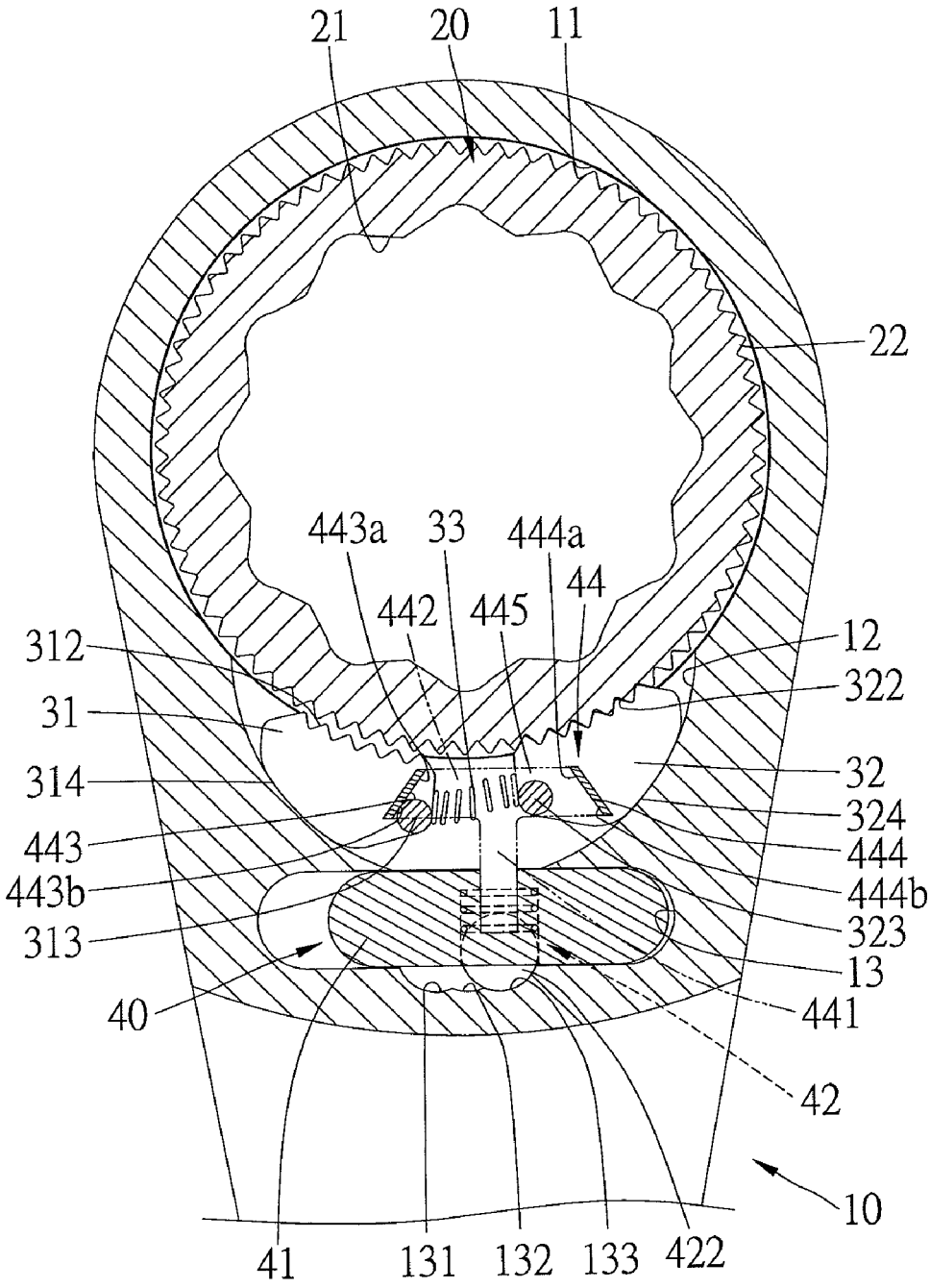
FIG. 8 shows a partial, cross sectional view of the ratchet wrench of FIG. 6 with a switch of the ratchet wrench in a second operative position.

When switch 41 is in second operative position (FIG. 8), ball 422 is received in third positioning groove 133. Teeth 322 of second pawl 32 are engaged with teeth 22 of drive member 20. Second coupling portion 323 of second pawl 32 is received in space 445 adjacent engaging portion 441. Second contact section 443*b* of first guiding portion 443 is engaged with first coupling portion 313 of first pawl 32, so that teeth 312 of first pawl 31 are disengaged from teeth 22 of drive member 20. In this state, handle 16 and drive member 20 can rotate in the clockwise direction to drive a fastener in the clockwise direction. Furthermore, handle 16 can rotate freely relative to drive member 20 in the counterclockwise direction without driving the fastener.

Figure 9:
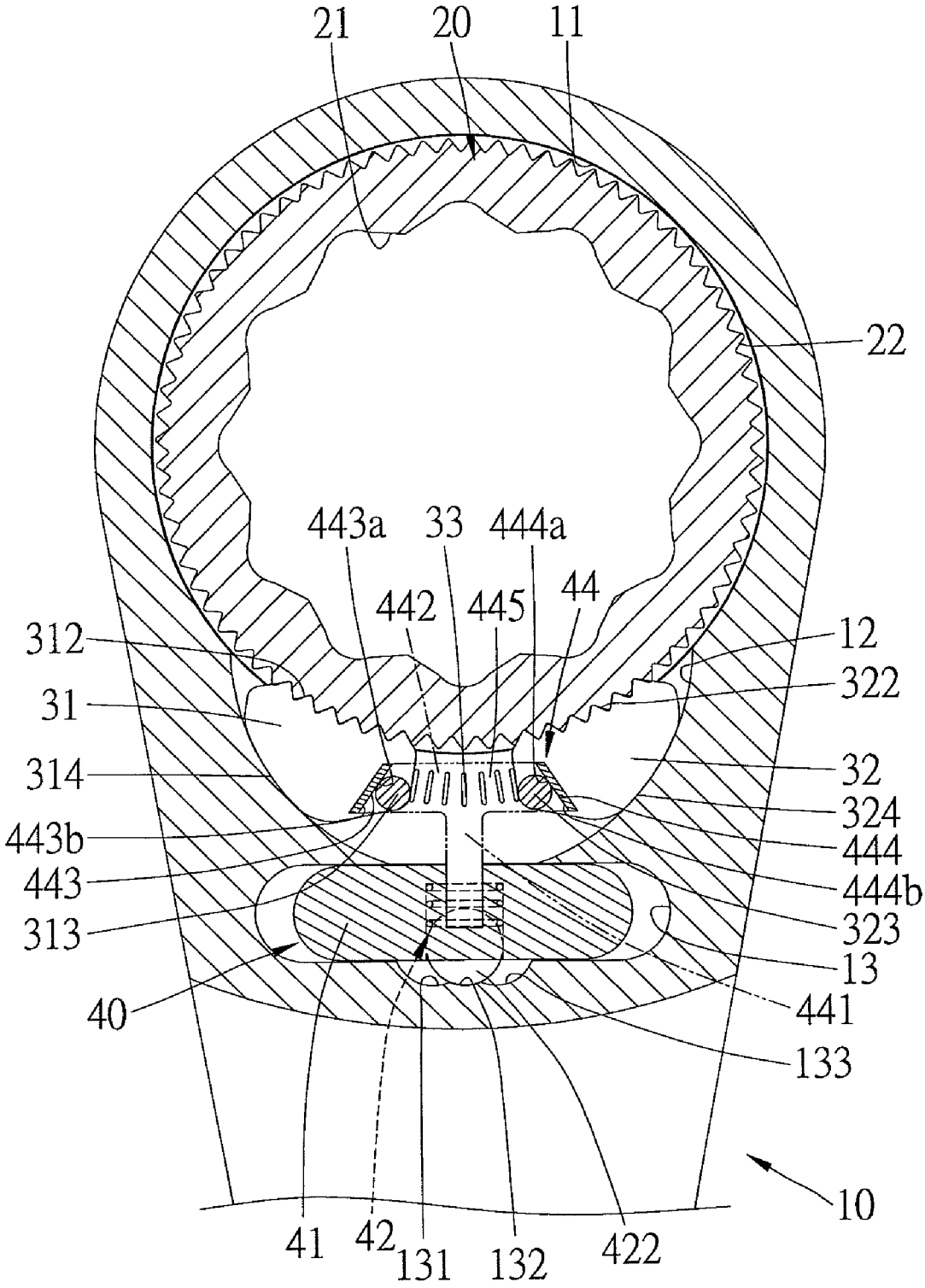
FIG. 9 shows a partial, cross sectional view of the ratchet wrench of FIG. 6 with a switch of the ratchet wrench in a third operative position.
Figure 10:
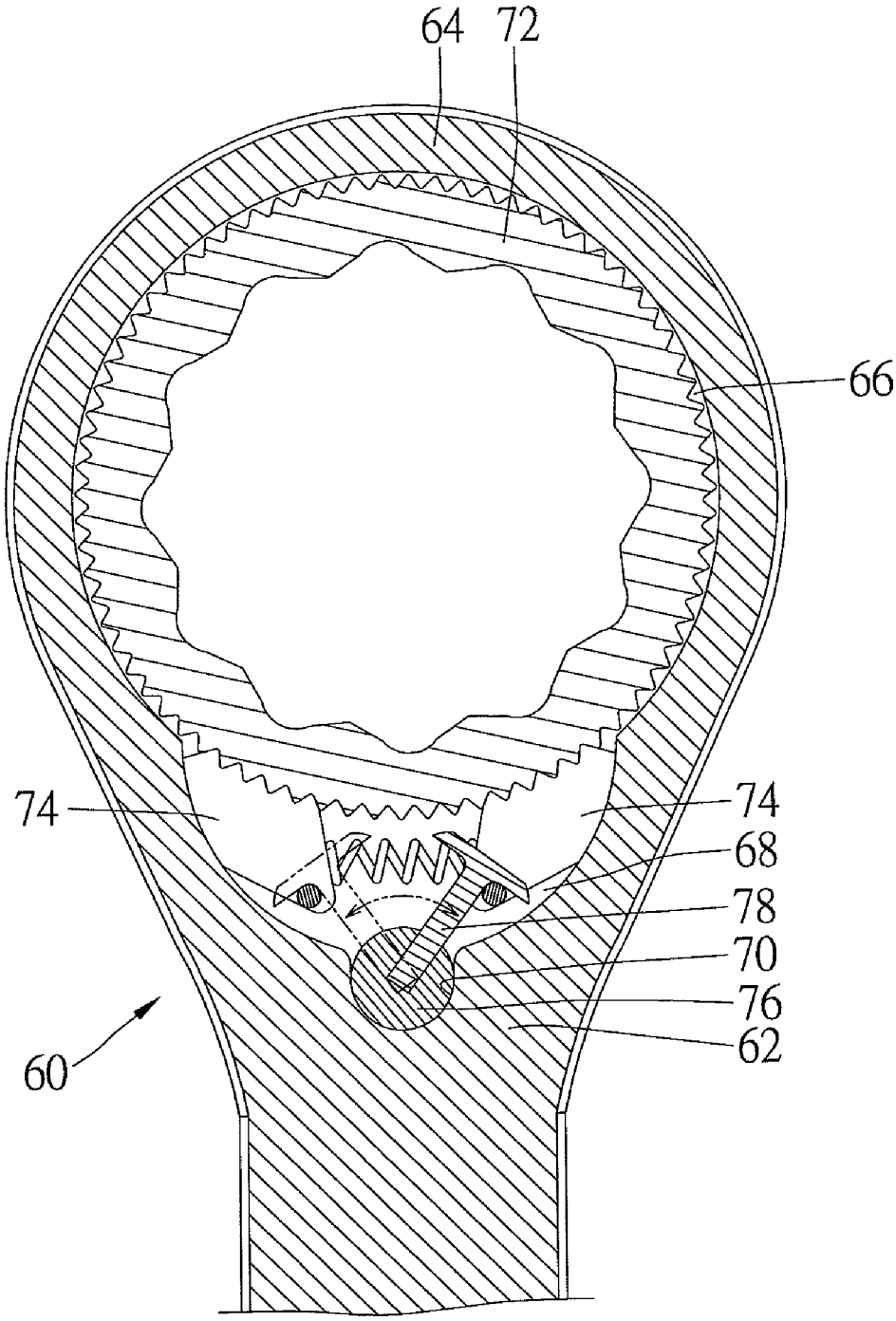
Fig. 10 PRIOR ART
FIG. 10 shows a partial, cross sectional view of a conventional ratchet wrench.

When switch 41 is in the third operative position (FIG. 9), ball 422 is received in second positioning groove 132. First and second coupling portions 313 and 323 of first and second pawls 31 and 32 are received in space 445 adjacent engaging portion 441. Namely, first and second coupling portions 313 and 323 are disengaged from second contact sections 443*b* and 444*b*. Teeth 312 and 322 of first and second pawls 31 and 32 are engaged with teeth 22 of drive member 20 under action of elastic element 33, allowing handle 16 and drive member 20 to rotate in either of clockwise and counterclockwise directions to drive the fastener in the same direction. Free rotation of handle 16 relative to drive member 20 in either direction without driving the fastener is not allowed.

It is noted that when switch 41 is moved between the first, second, and third operative positions, first and second coupling portions 313 and 323 of first and second pawls 31 and 32 are movably restrained in space 445. Furthermore, first coupling portion 313 of first pawl 31 comes in contact with and is guided by first contact section 443*a* of first guiding portion 443 when switch 41 is moved from the third operative position to the second operative position. Further, second coupling portion 323 of second pawl 32 comes in contact with and is guided by first contact section 444*a* of second guiding portion 444*b* when switch 41 is moved from the third operative position to the first operative position. Further, extension 442 slideably abuts tops of first and second coupling portions 313 and 323 of first and second pawls 31 and 32.

Now that the basic teachings of the present invention have been explained, many extensions and variations will be obvious to one having ordinary skill in the art. As an example, drive member 20 can include a drive section outside of head 14 and in the form of a drive column having square cross sections. Furthermore, the drive section can include a spring-biased coupler for releasable coupling with a socket. Positioning device 42 can be in the form of a resilient protrusion formed or fixed on a side of switch 41 without the need of drilling a hole 411 on the side of switch 41.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ratchet wrench comprising, in combination:

a head and a handle interconnected to the head, with the head including first and second sides spaced in a thickness direction, with the head further including a first compartment extending in the thickness direction, with the head further including a second compartment in communication with the first compartment and a third compartment in communication with the second compartment;

a drive member rotatably received in the first compartment, with the drive member including a plurality of teeth in an outer periphery thereof;

first and second pawls slideably received in the second compartment, with each of the first and second pawls including an inner face facing the plurality of teeth of the drive member, with the inner face of each of the first and second pawls including a plurality of teeth releasably engaged with the plurality of teeth of the drive member, with an elastic element being mounted between the first and second pawls to bias the first and second pawls away from each other to engage the plurality of teeth of the first and second pawls with the plurality of teeth of the drive member, with the first pawl including a first coupling portion, with the second pawl including a second coupling portion;

a switch slideably received in the third compartment between first, second, and third operative positions in a width direction transverse to the thickness direction; and an actuator slideably received in the second compartment and including an engaging portion having a first end engaged with the switch to move therewith, with the engaging portion further having a second end in the second compartment, with the actuator further including an extension extending transversely to the second end of the engaging portion, with the extension including a first guiding portion and a second guiding portion;

wherein when the switch is in the first operative position, the plurality of teeth of the first pawl are engaged with the plurality of teeth of the drive member, the second guiding portion of the actuator is engaged with the second coupling portion of the second pawl to disengage the plurality of teeth of the second pawl from the plurality of teeth of the drive member, allowing the handle and the drive member to rotate in a first direction driving a fastener in the first direction, and allowing the handle to rotate freely relative to the drive member in a second direction reverse to the first direction without driving the fastener, wherein when the switch is in the second operative position, the plurality of teeth of the second pawl are engaged with the plurality of teeth of the drive member, the first guiding portion of the actuator is engaged with the first coupling portion of the first pawl to disengage the plurality of teeth of the first pawl from the plurality of teeth of the drive member, allowing the handle and the drive member to rotate in the second direction driving the fastener in the second direction, and allowing the handle to rotate freely relative to the drive member in the first direction without driving the fastener, and wherein when the switch is in the third operative position, the plurality of teeth of each of the first and second pawls are engaged with the plurality of teeth of the drive member, allowing the handle and the drive member to rotate in either of the first and second directions driving the fastener, and not allowing free rotation of the handle relative to the drive member in either of the first and second directions without driving the fastener.

2. The ratchet wrench as claimed in claim 1, with the first and second guiding portions on opposite sides of the engaging portion, with each of the first and second guiding portions extending transversely to the extension and including a first contact section and a second contact section having a spacing to the extension larger than the first contact section, wherein when the switch is in the first operative position, the second contact section of the second guiding portion is engaged with the second coupling portion of the second pawl to disengage the plurality of teeth of the second pawl from the plurality of teeth of the drive member, wherein when the switch is in the second operative position, the second contact section of the first guiding portion is engaged with the first coupling portion of the first pawl to disengage the plurality of teeth of the first pawl from the plurality of teeth of the drive member, and wherein when the switch is in the third operative position, the first and second coupling portions are disengaged from the second contact sections of the first and second guiding portions.

3. The ratchet wrench as claimed in claim 2, with the second contact section of each of the first and second guiding portions having a spacing to the engaging portion larger than the first contact section, with each of the first and second contact sections having decreasing spacings to the engaging portion away from the switch.

4. The ratchet wrench as claimed in claim 3, with a first space defined between the first guiding portion and the engaging portion, with the first coupling portion of the first pawl movably received and restrained in the first space, with a second space defined between the second guiding portion and the engaging portion, and with the second coupling portion of the second pawl movably received and restrained in the second space.

5. The ratchet wrench as claimed in claim 4, with each of the first and second pawls further including a top face transverse to the inner face, with the first coupling portion formed on the top face of the first pawl, with the second coupling portion formed on the top face of the second pawl, and with the extension slideably abutting the top faces of the first and second pawls.

6. The ratchet wrench as claimed in claim 3, with the extension including upper and lower faces spaced in the thickness direction, with each of the first and second guiding portions extending downward from the lower face, with a space defined between the lower face and the first and second guiding portions, and with the first and second coupling portion movably received and restrained in the space.

7. The ratchet wrench as claimed in claim 6, with each of the first and second pawls further including a top face transverse to the inner face, with the first coupling portion formed on the top face of the first pawl, with the second coupling portion formed on the top face of the second pawl, with each of the first and second coupling portion having a top spaced from the top face in the thickness direction, and with the lower face of the extension slideably abutting the tops of the first and second coupling portions of the first and second pawls.

8. The ratchet wrench as claimed in claim 3, with the third operative position intermediate the first and second operative positions in the width direction, with the third compartment extending in the width direction, with the third compartment including a wall having first, second, and third positioning grooves with the first, second, and third positioning grooves spaced in the width direction, with the second positioning groove intermediate the first and third positioning grooves, with the ratchet wrench further comprising, in combination: a positioning device coupled with the switch and selectively engaged with one of the first, second, and third positioning grooves to retain the switch in one of the first, second, and third operative positions.

9. The ratchet wrench as claimed in claim 8, with the switch further including a side having a receptacle, with the positioning device including a ball and an elastic member received in the receptacle, with the ball biased by the elastic member to engage with one of the first, second, and third positioning grooves to retain the switch in one of the first, second, and third operative positions.

10. The ratchet wrench as claimed in claim 9, with the first compartment extending from the first side through the second side, with the second compartment intermediate the first and second sides in the thickness direction, with the second compartment intermediate the first and third compartments in a length direction perpendicular to the width and thickness directions, and with the third compartment extending from the first side toward and spaced from the second side in the thickness direction.

11. The ratchet wrench as claimed in claim 10, with each of the first and second pawls further including a top face transverse to the inner face, with the first coupling portion formed on the top face of the first pawl, with the second coupling portion formed on the top face of the second pawl, with the second compartment including a peripheral wall facing the first compartment, with each of the first and second pawls further including an outer face opposite to the inner face, with the outer face slideably abutting the peripheral wall of the second compartment, with the top face extending between the inner and outer faces, with each of the first and second pawls including an end face transverse to the top face and to the inner face, with the end faces facing each other and each having a receptacle, with the elastic element including two ends received in the receptacles.

12. The ratchet wrench as claimed in claim 3, with each of the first and second guiding portions being inclined and at an obtuse angle with the extension.

* * * * *